United States Patent [19]

Golub et al.

[11] Patent Number: 4,612,718

[45] Date of Patent: Sep. 23, 1986

[54] HOSPITAL IDENTIFICATION BANDS

[75] Inventors: Samuel G. Golub, Delray Beach, Fla.; Charles E. Garb, Jackson Heights, N.Y.

[73] Assignee: Graham Field, Inc., New Hyde Park, N.Y.

[21] Appl. No.: 692,920

[22] Filed: Jan. 18, 1985

Related U.S. Application Data

[63] Continuation-in-part of Ser. No. 470,511, Feb. 28, 1983, abandoned.

[51] Int. Cl.[4] ..... G09F 3/14

[52] U.S. Cl. ..... 40/21 C

[58] Field of Search ..... 40/21 C, 21 R; 24/16 PB, 30 R; 272/119; 224/164, 218, 219; 2/DIG. 6

[56] References Cited

U.S. PATENT DOCUMENTS 3,279,107 10/1966 Baumgartner ..... 40/21 C 4,142,310 3/1979 Groselak et al. ..... 40/21 R

*Primary Examiner*—Robert Peshock

*Assistant Examiner*—Cary E. Stone

*Attorney, Agent, or Firm*—Ostrolenk, Faber, Gerb & Soffen

[57] ABSTRACT

An identification band for identifying patients of hospitals and similar institutions is disclosed. The identification band includes a longitudinally elongated base layer formed of a tear-resistant, water-proof, ink-receptive material. The base layer includes an eyelet section, an information section and a tongue section. A slot is formed in the eyelet section. In a first embodiment, the width of the tongue section is less than that of the slot to enable the tongue section to be passed through the slot. An adhesive layer is formed on one surface of the tongue section over a sufficient layer of the tongue section such that when the tongue section is passed through the slot can be folded back on itself and two portions of the adhesive layer located on opposite sides of the slot can be placed in contact with each other. In a second embodiment, the slot has at least one arcuate edge and its width is less than the width of the tongue section such that the tongue section must be bent into an arcuate shape in order to pass it through the slot. A plurality of pairs of slits are formed on opposite edges of the tongue section such that each slit defines an anchoring flap. The distance, as measured in the width direction of the tongue section between the inner ends of the slits, is less than or equal to the width of the slot such that successive anchoring flaps engage the base layer surrounding the slot as they are passed through the slot. In this embodiment, an adhesive layer is formed on one surface of the base layer adjacent the slot so that after the tongue section is passed through the slot, it may be placed in contact with the adhesive layer.

13 Claims, 10 Drawing Figures

10
12
14
16
18
20
22
24
26
28
30
32
34
36
38

HOSPITAL IDENTIFICATION BANDS

RELATED APPLICATIONS

This is a continuation-in-part of U.S. application Ser. No. 470,511 dated Feb. 28, 1983 abandoned.

BACKGROUND OF THE INVENTION

The present invention relates to identification bands for idnetifying patients of hospitals and similar institutions. More particularly, the present invention is directed towards a disposable identification band which is simple and inexpensive to manufacture, simple to use and which cannot be removed without rendering the band unfit for further use.

The most common identification bands used in hospitals today are formed of a plastic material and are secured around the wrist or other limb of a patient using a metal clip or snap. These clips are uncomfortable for the wearer and often require the use of a tool for securing them about the patient's limb. Other prior art identification bands provide a pocket in which a previously prepared card bearing the necessary identifying information may be inserted and the pocket subsequently sealed. Such bands are relatively complex in construction and require that the identifying information first be placed on a card which must then be manually placed in a pocket. These additional steps are time-consuming and inconvenient to hospital personnel.

It is an object of the present invention to provide an identification band of improved and simplified construction which can be manufactured on high-speed automatic equipment to provide high volume production at a relatively low cost.

It is further an object of the present invention to provide an identification band which is very simple to use and which provides a strong permanent band placed around the limb of the user.

BRIEF DESCRIPTION OF THE INVENTION

In accordance with the first embodiment of the invention, the identification band is a laminate including an elongated base layer formed of a tear-resistant waterproof, ink-receptive material such as that sold under the trademark ASCOT. An identification section is provided on the base layer to provide space for identifying material, such as the patient's name, doctor's name, etc. If desired, lines can be preprinted onto this section to aid in the entry of the identifying material. The identifying material can be typed, handwritten or otherwise impressed onto the identifying section. A slot is formed adjacent one end of the base layer and is preferably secured by an additional support layer which provides extra strength in the area surrounding the slot. The opposite end of the base layer is narrowed and elongated to form a tongue section which is adapted to fit through the slot when the band is folded into a cylindrical shape. An adhesive layer is formed on one side of the tongue section of the base layer and is normally covered by one or more protective strips. When the band is to be placed around the patient, the protective strips are removed and the tongue section is inserted approximately halfway into the slot. The diameter of the band is adjusted by adjusting the degree to which the tongue is inserted through the slot. Once the desired diameter has been obtained, the tongue is folded back on itself such that the adhesive layer located on the portion of the tongue section extending through the slot is placed in contact with the adhesive layer on the portion of the tongue section which is not placed through the slot. This structure makes it possible to adjust the diameter of the band and provides a strong adhesive connec-tion which prevents the band from accidentally opening. Additionally, since there is a double layer of material in the area where the tongue section extends through the slot, an extremely strong connection is made.

In the presently preferred embodiment, a plurality of individual identification bands are formed in a single sheet or roll of the base layer material and the individual identification bands are die cut from the sheet or roll. The extra support layer, as well as the adhesive layers and the protective strips, are applied by machine to the base layer. By die cutting the individual identification bands either with score lines or with spaced perforations, the individual identification bands can be removed when desired from the sheet. The sheet may be placed in a typewriter and the identifying material types directly onto the information section of the identification band.

In accordance with the second embodiment of the invention, the adhesive layer is placed adjacent the slot rather than on the tongue section. In this embodiment, the slot is ofrmed with one straight edge and one arcuate edge. The width of the tongue is greater than the width of the slot so that the tongue must be bent into an arcuate shape in order to place it within the slot. A plurality of slits are formed in pairs at spaced locations on either side of the tongue section. When the identification band is to be placed on the patient, the tongue section is inserted into the slot and is pulled through until the diameter of the identification band reaches a desired size. As each associated pair of slits passes through the slot, the base material adjacent the slits snaps out beyond the width of the slot and engages the top surface of the base layer. In this manner, the slits define a ratchet-type mechanism which prevents the tongue section from accidentally withdrawing through the slot once the respective pair of slits has passed through the slot. In this way the ratchet mechanism acts as a temporary holding mechanism.

In this embodiment, an adhesive layer is formed adjacent the slot and is covered by a protective strip. Once the tongue section has been inserted through the slot to a desired length, the protective strip is removed and the tongue section is placed in contact with the adhesive layer. Any portion of the tongue section which extends beyond the adhesive layer may be removed by cutting. This embodiment is somewhat less expensive to manufacture than the first embodiment since it requires less adhesive material. It provides substantially the same support, however, due to the additional support provided by the cooperation between the slot and the slits.

BRIEF DESCRIPTION OF THE DRAWINGS

For the purpose of illustrating the invention, there is shown in the drawings a plurality of embodiments which are presently preferred, it being understood, however, that the invention is not limited to the precise arrangements and instrumentalities shown.

DETAILED DESCRIPTION OF THE PREFERRED EMBODIMENTS

Figures 1, 2, 3, 4:
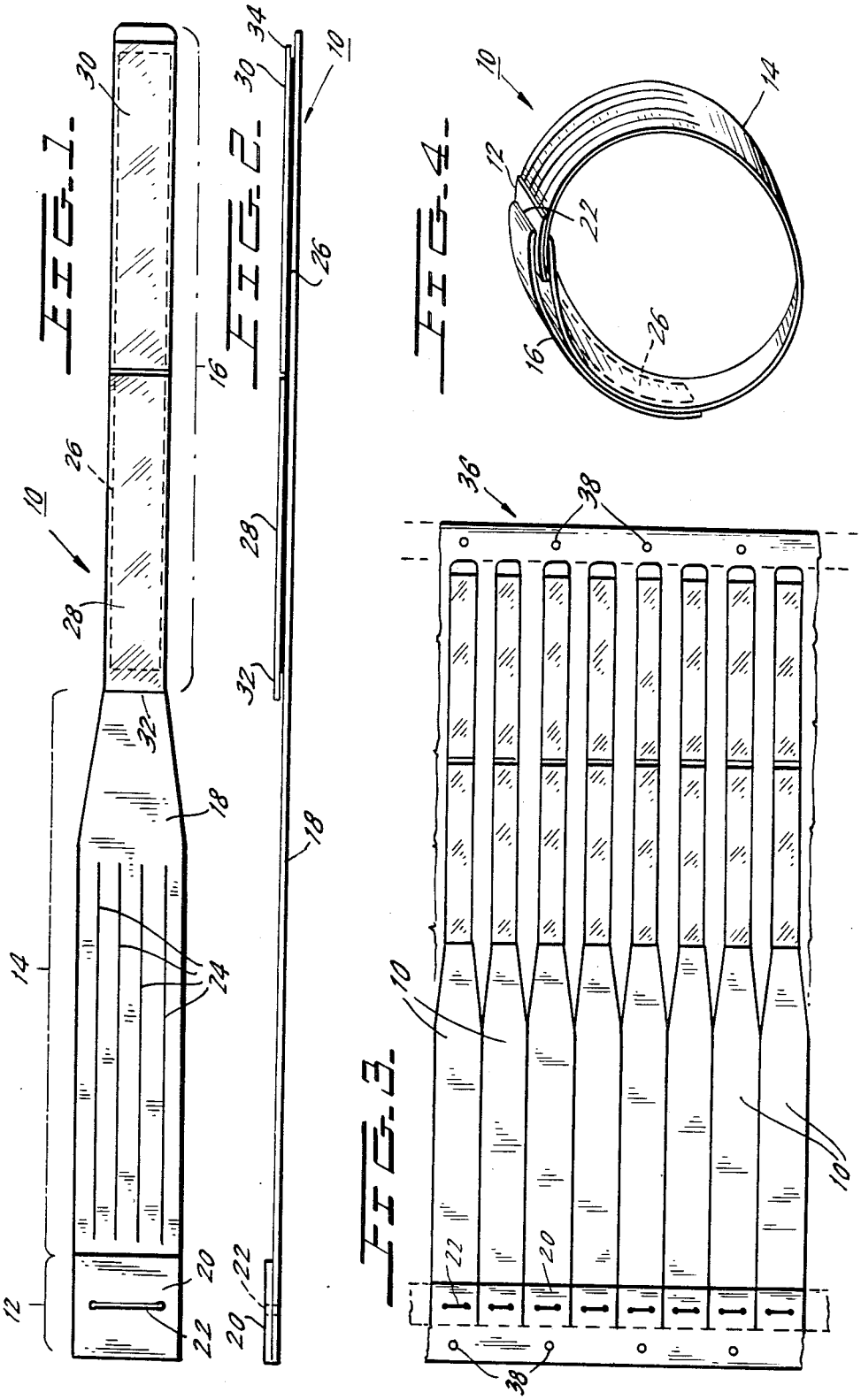
FIG. 1 is a top view of a first embodiment of an identification band constructed in accordance with the principles of the present invention.
FIG. 2 is a side view of the identification band of FIG. 1.
FIG. 3 is a partial view of an elongated sheet containing a plurality of the bands of FIG. 1.
FIG. 4 is a perspective view of the band in FIG. 1 in its operative position.

Referring now to the drawings wherein like numerals indicate like elements, there is shown in FIGS. 1 and 2 an identification band constructed in accordance with the principles of the present invention and designated generally as 10. Identification band 10 is preferably formed on a waterproof, ink-receptive material which is sufficiently tearresistant to ensure that the band will not tear or break during normal use. One such material is formed of a Tyvec® material which is coated with a resiny surface which is ink-receptive, and which is sold under the trademark ASCOT.

The identification band 10 includes an eyelet section 12, an information section 14 and a tongue section 16. The identification band 10 is a laminated structure including a base layer 18 formed of ASCOT and extending the entire length of the identification band. In the presently preferred embodiment, a support layer 20, also made of ASCOT, is formed in the eyelet section 12 to provide additional strength at that section. A slot 22 extends through both the base layer 18 and the support layer 20 of the eyelet section 12. As illustrated in FIG. 2, the support layer 20 is formed of a separate piece of ASCOT. If desired, the support layer 20 can be formed by folding the base layer 18 onto itself to form an area of double thickness.

The information section 14 is formed from the single base layer 18 but preferably has a plurality of guide lines 24 printed thereon. These lines can be used as a guide for writing, typing or otherwise imprinting desired information (such as the name of the patient, the attending doctor, etc.) on the band 20. If desired, headings such as "Patient's Name", "Doctor's Name", etc. can be permanently imprinted onto the identification band at the information section 14.

The tongue section 16 is narrowed and elongated to permit it to be threaded through the slot 22 in a manner described below. The tongue section is preferably 30%-50% of the entire length of the band 10. As best shown in FIG. 2, the tongue section 16 has an adhesive layer 26 formed on the base layer 18, the adhesive layer 26 extends substantially the entire length of the tongue section 16. The adhesive layer 26 is preferably of a type which adheres strongly to itself such that when one portion of the tongue section 16 is turned back on to a second portion of the tongue section 16, the two portions will be firmly and permanently affixed to one another.

A pair of removable protective strips 28, 30 are located on top of the adhesive layer 26. These strips are preferably formed of a wax coated or plastic material which will adhere to the adhesive layer 26 but which may be easily peeled off of the adhesive layer without tearing the strips. Portions 32, 34 of the strips 28, 30, respectively, extend beyond the adhesive layer 26 as illustrateds in FIG. 2 to enable the user to easily grasp the strips in order to remove them from the adhesive layer.

After appropriate identifying information has been applied to the information section 14 of identification band 10, the strips 28, 30 are removed from the adhesive layer 26 and the tongue section 16 is inserted through the slot 22 causing the band 10 to assume a generally circular shape. The degree to which the tongue section 16 is inserted into the slot 22 is determined by the size of the wrist or other appendage around which the identification band 10 is to be placed. When the diameter of the resultant band is at a desired size, the tongue section 16 is bent back upon itself in the manner illustrated in FIG. 4 so that two different sections of the adhesive layer 26 come into contact with one another. As a result of this structure, the adhesive layers adhere strongly together and it is substantially impossible to separate the two overlapping sections of the tongue section 16. Since the material of which the base layer 18 is formed is not tearable, the band can be effectively removed only by cutting the same. As best illustrated in FIG. 4, either end of the band will be of double thickness in the area of the slot 22 which results in extremely strong connection between the two ends of the band.

In the presently preferred embodiment, a plurality of identification bands 10 are formed in a single elongated sheet 36 as illustrated in FIG. 3. The entire width of the sheet 36 is preferably formed of the ASCOT material and defines the base layer 18 of the identification bands 10. The remaining layers 20, 26, 28 and 30 are formed on the base layer 18. The outline of the individual identification bands 10 are defined either by score marks or by perforations such that the individual bands 10 may be removed from the sheet 36. If desired, holes 38 may be formed on either side of the sheet 36 to enable the sheet 36 to be engaged by appropriate protrusions in a typewriter platen to move the sheet 36 through the typewriter. The sheet 36 can be formed of any desired size, such as a standard letter size, or may be a continual roll or leafed sheet such as that which is typical in computer paper.

A second embodiment of the present invention is illustrated in FIGS. 5-10. This embodiment is somewhat simpler in construction and cost of manufacture than the embodiment of FIGS. 1-4. Elements of the embodiment of FIGS. 5-9 which correspond to similar elements of the embodiment of FIGS. 1-4 are indicated by the use of a "prime" next to the identifying character. The main difference between the embodiment of FIGS. 5-10 and that of FIGS. 1-4 resides in the location of the adhesive layer 26′ and the addition of slits 40 in the tongue section 16′. The slits 40 define anchoring flaps 42 (see FIG. 9) which cooperate with slot 22′ to define a ratchet mechanism which temporarily holds the tongue section 16′ in place relative to the information section 14′ before the sections are permanently adhered to the adhesive layer 26′. This is highly advantageous since it allows the nurse to place the tongue section 16' through the slot 22, tighten the band around the patient's limb to a desired degree, and then let go of the tongue section so as to free her hand to remove the protective sheet 28' from the adhesive layer without fear that the tongue section 16' will slip through the back through the slot 22'. This simplifies the manner in which the identification band is placed on the patient.

Figure 5:
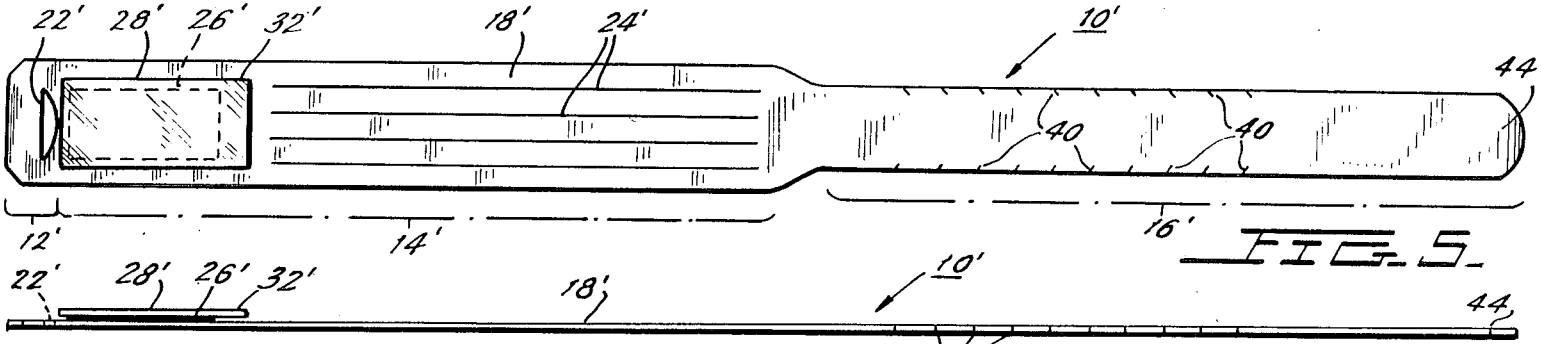
FIG. 5 is a top view of a second embodiment of an identification band constructed in accordance with the principles of the present invention.
Figure 6:
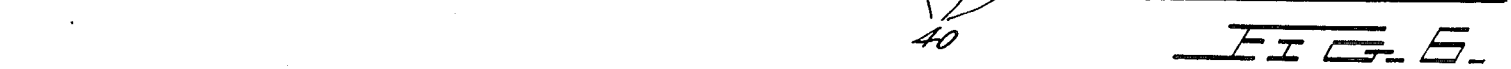
FIG. 6 is a side view of the band of FIG. 5.

As best shown in FIG. 5, the slot 22' is arcuate in shape and is of lesser width than the width W (see FIG. 9) of the tongue section 16'. As such, the tongue section 16' must be bent into an arcuate shape in order to be fit into the slot 22'. Once the end 44 of the tongue section 16' has been inserted through the slot 22', it is pulled through the slot until the diameter of the band 10' is of a desired size. As the tongue section 16' is pulled through the slot 22', successive pairs of slits 40 will pass through the slot 22'. The distance D extending between the inner ends of each pair of slits 40 is less than or equal to the width of the slot 22'. The slits 40 extend obliquely to the longitudinal direction of the band 10 to operate as a ratchet mechanism. The relative size of the split 40 and the slot 22', and the relative stiffness of the base layer 18 are such that the tongue section 16' can be withdrawn back out from the slot 22' by the nurse if desired. Thus, while the slits 40 and slot 22' operate to define a ratchet mechanism which will prevent the tongue section 16' from accidentally slipping out through the slot 22, the action of the ratchet mechanism can be overcome by the nurse by merely applying additional force to pull the tongue section 16' out of the slot 22'.

Figure 8:
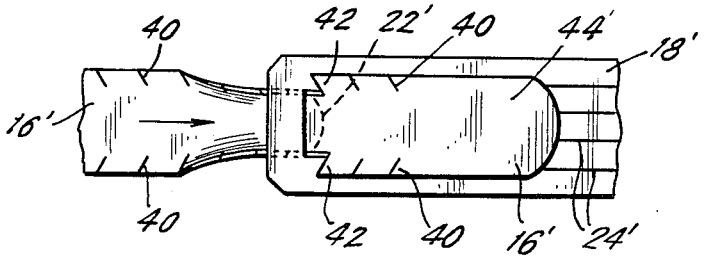
FIG. 8 is a detailed view illustrating the cooperation between the slits formed in the tongue section and the slot formed in the eyelet section of the identification band as the tongue section is advanced through the slot in the eyelet section.
Figure 9:
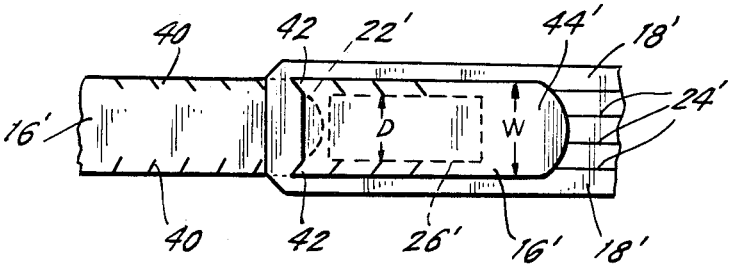
FIG. 9 is a detailed view illustrating the manner in which opposite ends of the band are connected together in the operative position.
Figure 10:
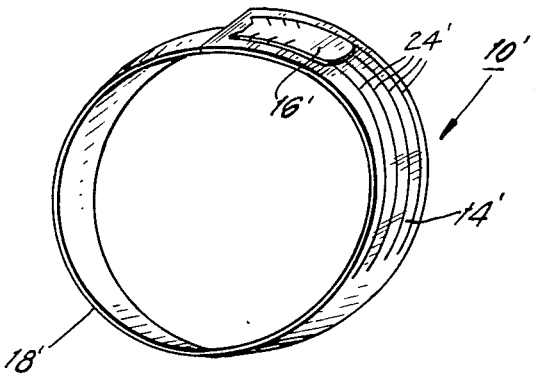
FIG. 10 is a perspective view of the band in FIG. 5 in its operative position.

As a given pair of slits 40 pass through the slot 42, they will be free of restraint from the opposite ends of the slot 42 and will snap outward (vertically in FIGS. 8 and 9). As a result, the portion of the tongue section 16' which has already been passed through the slot 22', will be flat and the anchoring flaps 42 associated with those slits will extend beyond the width of the slot 42. In contrast, the portion of the tongue section 16 which has not yet passed through the slot 42 is arcuate in shape and has a smaller width than that portion which has already passed through the slot. See FIG. 8. Once the band has reached the desired diameter, the tongue section 16' is pulled back through the slot 22' (to the left if FIGS. 8 and 9) to cause the rear ends of the closest anchoring flaps 42 to rest against the top surface of the base layer 18' adjacent the slot 22'. See FIG. 9. Since the innermost portion of the slits 40 is adjacent the outermost portion of the slot 22' once the tongue section 16' has been pulled back through the slot 22' to the position shown in FIG. 9, the portion of the tongue section 16' which has not yet been passed through the slot is permitted to flatten, so that the band 10' can fit comfortably around the limb of the patient. Once the band 10' has been placed in this position, the protective sheet 28' which is adhered to the adhesive layer 26' to permanently adhere the tongue section 16' to the information section 14'. In this connection, the adhesive layer should be formed of a material that is sufficiently strong to make it substantially impossible to pull said tongue section 16' back through said slot 22' after said tongue section 16' has been applied to said adhesive. If the end 44 of the tongue section 16 extends too far past the adhesive layer 26', it may be removed by cutting with a scissor or in any other desired manner. While the adhesive layer is illustrated as being formed on the identification section 14', it can alternatively be placed on the tongue section 16' or any other appropriate section of base layer 18.

Figure 7:
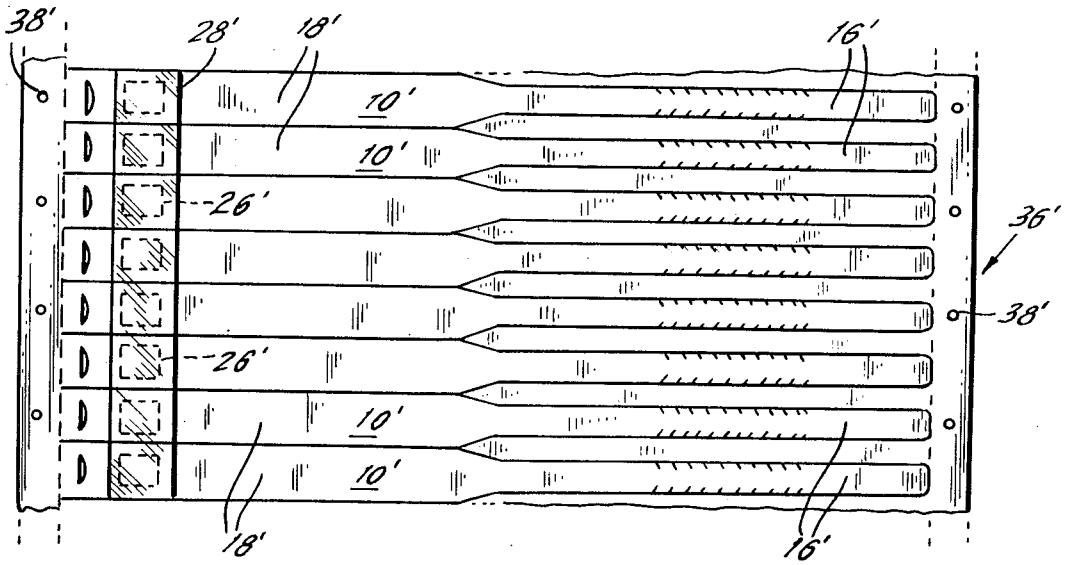
FIG. 7 is a partial view of an elongated shee containing a plurality of the bands of FIG. 5.

As illustrated in FIG. 7, the identification bands 10' may be formed in a single sheet in a similar manner to that illustrated in FIG. 3. For simplicity of manufacture, a single continuous strip 28' can extend the entire length of the sheet to cover each of the adhesive layers 26'. In such a case, horizontal perforations (not shown) should be located at spaced intervals along the strip 28 so that an individual strip 28' will remain with each identification band 10' when the band 10' is removed from the sheet 36'.

The present invention may be embodied in other specific forms without departing from the spirit or essential attributes thereof and, accordingly, reference should be made to the appended claims, rather than to the foregoing specification as indicating the scope of the invention.

What is claimed is:

1. An identification band, comprising:

a longitudinally elongated base layer formed of a tear-resistant, waterproof, ink-receptive material, said base layer including an eyelet section, an information section and a tongue section, said tongue section extending 30 to 50% of the entire length of said band as measured in the longitudinal direction of said band and being narrower than said eyelet and information sections throughout its entire length, said information section being sufficiently large to permit appropriate identifying material to be imprinted thereon;

a slot formed in said eyelet section, the width of said slot being greater than the width of said tongue section such that said tongue section can be passed through said slot, said slot extending generally transverse to said longitudinal direction of said band; and an adhesive layer formed on one surface of said tongue section and over substantially the entire longitudinal length of said tongue section so that when said tongue section is passed through said slot it can be folded back upon itself and two portions of said adhesive layer located on opposite sides of said slot can be placed in contact with each other.

2. The identification band of claim 1, wherein said base layer is formed of a tear-resistant material which is coated with a resiny surface which is ink-receptive.

3. The identification band of claim 1, wherein one or more guide lines are formed on said information section.

4. The identification band of claim 3, further including at least one heading associated with said guide lines.

5. The identification band of claim 4, further including an extra support layer located on said base layer in the area of said eyelet section and surrounding said slot.

6. The identification band of claim 1, further inlcuding a removable protective layer located on top of said adhesive layer.

7. An identification band, comprising:

a longitudinally elongated base layer formed of a tear-resistant, waterproof, ink-receptive material, said ink-receptive material being of the type which will easily crease when folded, said base layer including an eyelet section, an information section and a tongue section, said information section being sufficiently large to permit appropriate identifying material to be imprinted thereon;

a slot formed in said eyelet section, said slot having at least one arcuate edge, the width of said slot being less than the width of said tongue section such that said tongue section must be bent into an arcuate shape in order to pass it through said slot;

a plurality of pairs of slits formed on opposite widthwise edges of said tongue section such that each slit defines an anchoring flap, the distance as measured in the width direction of said tongue section between the inner ends of each pair of slits being less than or equal to the width of said slot, the relative stiffness of said eyelet section in the area of said slot and said tongue section in the area of said slits being such that said tongue section is bent into a U-shape as it is pulled through said slot and comes back to a flat shape after being pulled backward a short distance through said slot, the stiffness of said tongue section being sufficiently low that said tongue section can be easily withdrawn form said slot after said tongue section has been inserted into said slot and a pair of said slits has engaged said eyelet section, and an adhesive layer formed on said base layer, said adhesive permitting said tongue section to be adhered to said eyelet section after said tongue section is passed through said slot, said adhesive layer being formed of an adhesive material which is sufficiently strong to make it substantially impossible to pull said tongue section from said eyelet section after said tongue section has been adhered to said eyelet section by said adhesive, said slits serving to temporarily hold said tongue section in a desired position after said tongue section has been passed through said slot a sufficient degree to adjust the diameter of said band to a desired length at which time said tongue section can be permanently held in said position by adhering said tongue section to said adhesive layer.

8. The identification band of claim 7, wherein one or more guidelines are formed on said information section.

9. The identification band of claim 8, further including at least one heading associated with said guidelines.

10. The identification band of claim 9, wherein said slits are formed at an angle oblique to the longitudinal direction of said identification band.

11. The identification band of claim 10, further including a removable protective layer located on said adhesive layer.

12. The identification band of claim 11, wherein said tongue section extends 30–50% of the entire length of said band as measured in the longitudinal direction of said band.

13. The identification band of claim 12, wherein said slot has two edges, said arcuate edge and a straight edge which extends perpendicular to said longitudinal direction of said identification band.

* * * * *